US005364335A

United States Patent [19]

Franzen et al.

[11] Patent Number: 5,364,335

[45] Date of Patent: Nov. 15, 1994

[54] DISC-DECANTER CENTRIFUGE

[75] Inventors: Paul H. Franzen, Stamford, Conn.; Ken J. Alit, Katonah, N.Y.; Richard R. Michaud, Waterbury, Conn.; Helmuth Probstmeyer, Bridgeport, Conn.; Michael R. Tammone, Monroe, Conn.

[73] Assignee: Dorr-Oliver Incorporated, Milford, Conn.

[21] Appl. No.: 162,994

[22] Filed: Dec. 7, 1993

[51] Int. Cl.[5] ..... B04B 1/04; B04B 1/20; B04B 9/00; B04B 9/12

[52] U.S. Cl. ..... 494/15; 494/46; 494/53; 494/62; 494/67; 494/70; 494/82; 494/83; 494/84

[58] Field of Search ..... 494/10, 15, 46, 52–55, 494/60, 62, 64, 67, 68, 70, 82–84; 210/364–367, 377, 380.1

[56] References Cited

U.S. PATENT DOCUMENTS

| | | | |
|---|---|---|---|
| 1,780,655 | 11/1930 | Nyrop . | |
| 2,129,992 | 9/1938 | Mattia | 494/62 X |
| 2,622,794 | 12/1952 | Smith | 494/53 |
| 2,679,974 | 6/1954 | Gooch . | |
| 2,711,854 | 6/1955 | Kjellgren | 494/53 X |
| 2,733,856 | 2/1956 | Kjellgren . | |
| 2,740,580 | 4/1956 | Schmiedel . | |
| 2,743,864 | 5/1956 | Lyons . | |
| 2,831,575 | 4/1958 | Maino | 209/211 |
| 2,837,272 | 6/1958 | Laguilharre . | |
| 2,862,658 | 12/1958 | Dahlgren | 494/54 X |
| 3,279,689 | 10/1966 | Honeychurch . | |
| 3,321,131 | 5/1967 | Cook . | |
| 3,764,062 | 10/1973 | Brautigam . | |
| 3,795,361 | 3/1974 | Lee . | |
| 3,885,734 | 5/1975 | Lee . | |
| 4,005,817 | 2/1977 | Charlton et al. . | |
| 4,009,823 | 3/1977 | Nozdrovsky | 494/53 X |
| 4,042,172 | 8/1977 | Nozdrovsky | 494/53 |
| 4,298,159 | 11/1981 | Epper et al. . | |
| 4,714,456 | 12/1987 | Bender et al. | 494/53 X |
| 4,957,475 | 9/1990 | Kreill | 494/83 X |

FOREIGN PATENT DOCUMENTS

| | | | |
|---|---|---|---|
| 2662373 | 11/1991 | France | 494/53 |
| 371755 | 4/1932 | United Kingdom | 494/53 |
| 425656 | 4/1974 | U.S.S.R. | 494/53 |
| 553001 | 4/1977 | U.S.S.R. | 494/53 |

OTHER PUBLICATIONS

"The Merco Centrifuge" For a wide range of centrifugal separations in the process industries, Bulletin 2614 Dorr-Oliver Incoporated, 1991.

"The MercoBowl Centrifuge" For a wide range of centrifugal separations in the process industries, Bulletin No. MB-2 Dorr Oliver Incorporated, 1984.

*Primary Examiner*—David A. Scherbel
*Assistant Examiner*—Charles Cooley
*Attorney, Agent, or Firm*—DeLio & Peterson

[57] ABSTRACT

A vertically oriented centrifuge swivably engaged to a support structure so as to enable the centrifuge to attain an optimal operational attitude. The centrifuge includes a bowl, a screw conveyor disposed within the bowl, a hub disposed within the upper portion of the screw conveyor wherein the screw conveyor and hub define a separation chamber, and a plurality of separating discs disposed in the separation chamber and arranged in superimposed layers upon the hub.

16 Claims, 8 Drawing Sheets

DISC-DECANTER CENTRIFUGE

BACKGROUND OF THE INVENTION

1. Field of the Invention

The present invention relates to a centrifugal separator and more particularly, to a high efficiency and unrestrained centrifugal separator.

2. Description of Related Art

A centrifuge is a device for separating substances of different specific gravities or particles sizes by extremely rapid rotation that produces centrifugal forces. Typically, centrifuges are utilized to separate resins, to clarify and dewater pigment in the chemical industry, recover corn starch and to concentrate protein and extracts in the food industry. Centrifuges are also used in the metallurgical and non-metallurgical fields for dewatering hydroxy based slurries for tanneries and metal plating companies.

One significant problem with conventional centrifuges is the vibrations which occur during operation of the centrifuge. One cause of such vibrations is that the centrifuge is constructed in a manner such that the centrifuge cannot attain an optimal operational attitude. One conventional method for alleviating such vibrations is to constrain the centrifuge. However, constraining the centrifuge causes significant forces to be exerted upon the bearings utilized in the centrifuge. Such forces can ultimately lead to destruction of the bearings and the inoperability of the centrifuge.

Another deficiency with conventional centrifuges is that the separation efficiency of such centrifuges is not adequate to meet industry's demanding requirements which warrant a high separation efficiency. Separation efficiency is comprised of three factors: (1) speed of separation, (2) degree of separation, and (3) separation capacity.

Bearing in mind the problems and the deficiencies of the prior art, it is therefore an object of the present invention to provide a new and improved centrifuge that is vibration free and does not have to be restrained.

It is a further object of the present invention to provide a new and improved centrifuge that has an increased separation efficiency.

It is yet another object of the present invention to provide a new and improved centrifuge that can be manufactured at a reasonable cost.

SUMMARY OF THE INVENTION

The above and other objects, which will be apparent to those skilled in the art, are achieved in the present invention which is directed to a centrifuge having a vertical axis of rotation and supported by a support structure for effecting the separation of a feed mixture into multiphase fractions, the centrifuge comprising a shaft positioned upon and rotatably attached to the support structure, a bowl coaxially attached to and rotatable with the shaft, a heavy fraction chamber adjacent to one end of the bowl in communication with the interior thereof through a heavy fraction discharge opening, an inlet means in communication with the bowl for introducing the mixture into the bowl, a rotatable screw conveyor longitudinally disposed within and coaxial with the bowl, a hub member disposed within the upper portion of the screw conveyor and coaxially attached to and rotatable with the bowl, the space intermediate the conveyor and the hub member defining a separation chamber, a plurality of separating discs disposed in the separation chamber and stacked in superimposed layers upon the hub member, means for distributing the mixture into the separation chamber, means coupled to the shaft and conveyor for rotating the bowl and conveyor at different speeds whereby the separating discs and the centrifugal force produced by the rotation of the bowl cooperate to effect a separation of the feed mixture into at least a light and heavy fraction, the difference in rotational speeds between the bowl and conveyor causing the heavy fraction to move along the inner face of the bowl to the heavy fraction discharge chamber, and a light fraction discharge outlet in communication with the separation chamber for discharging the light fraction from the bowl.

DESCRIPTION OF THE PREFERRED EMBODIMENT

Figure 1:
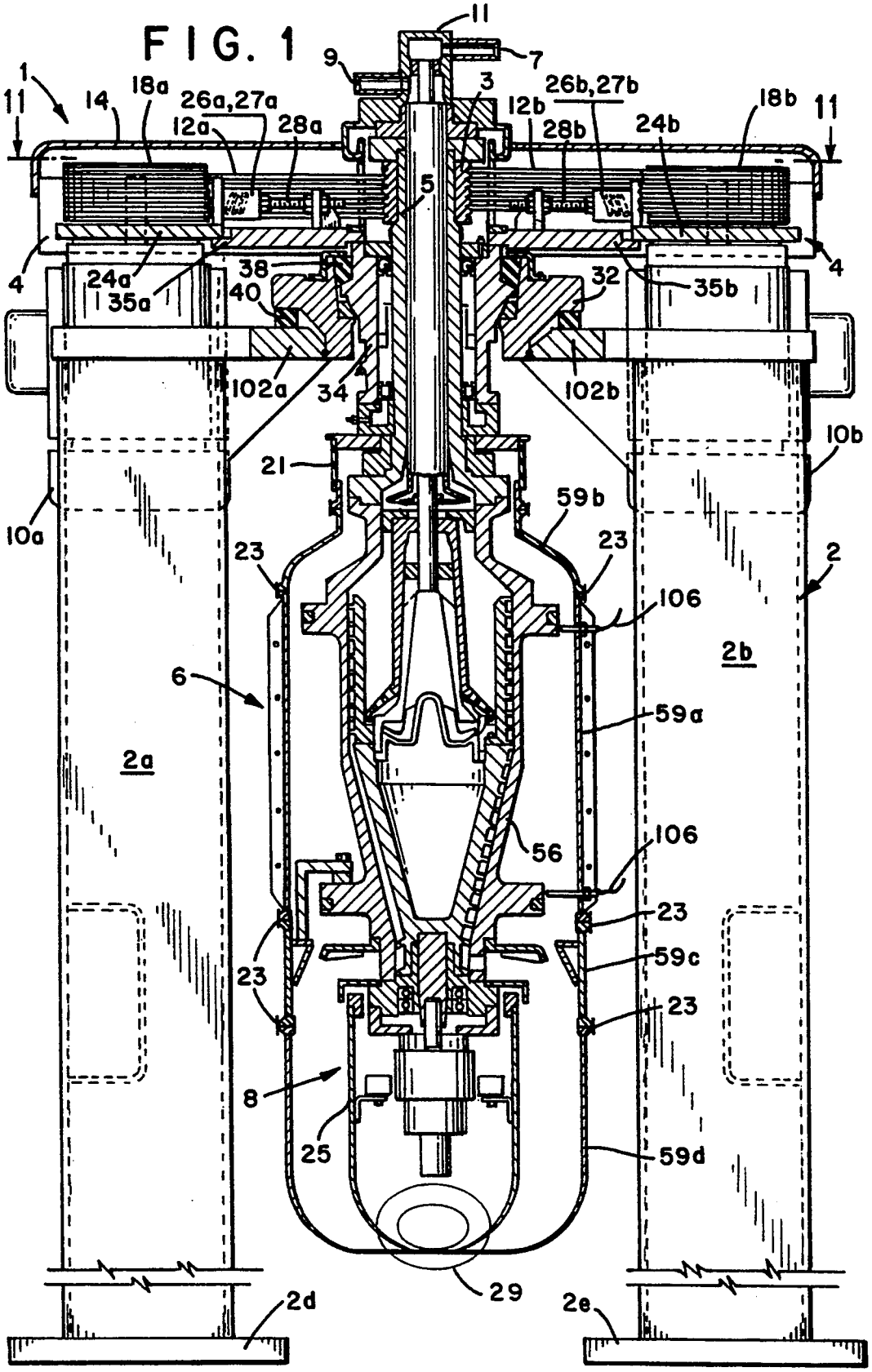
FIG. 1 is a front elevational view of the disc-decanter centrifuge of the present invention.

The disc-decanter centrifuge 1 of the present invention, shown in FIG. 1, is supported by support structure 2 and consists generally of free translating pendular drive system 4, bowl assembly 6 and back drive assembly (differential speed conveyor) 8. Support structure comprises columns 2*a–c* attached to corresponding bases 2*d–f*, respectively, and support arms 2*g* and 2*h*. (see also FIG. 11 ).

Figure 3:
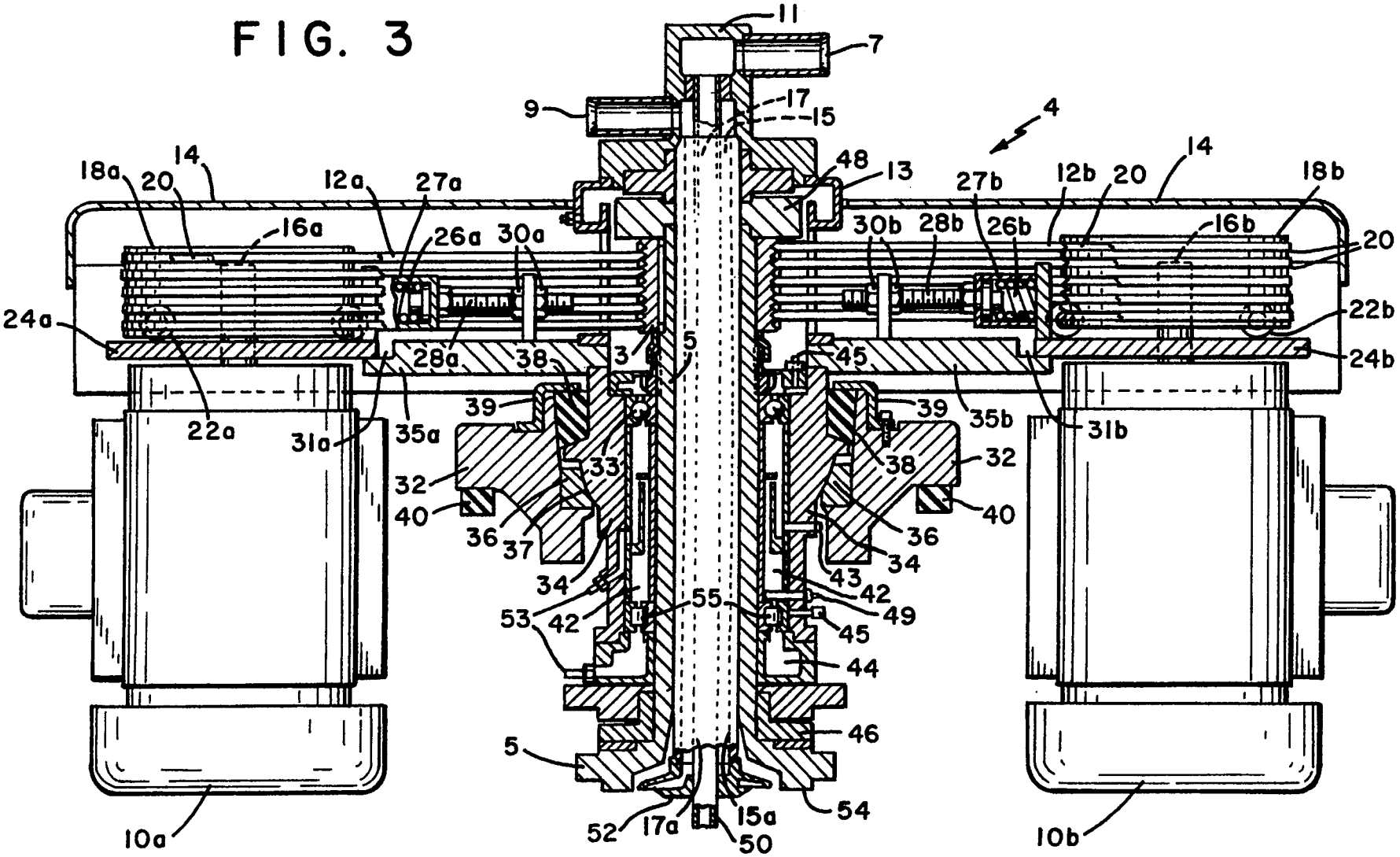
FIG. 3 is an enlarged front elevational view of the centrifuge drive system depicted in FIG. 1.

Referring to FIG. 3, drive system 4 includes diametrically positioned motors 10*a*, 10*b* of equal horse power. In a preferred embodiment, motors 10*a*, 10*b* are capable of generating rotational speeds of at least 6,000 r.p.m. (revolutions per minute). Motors 10*a*, 10*b* are drivingly engaged with pulley 3 which is mounted on elongated hollow spindle shaft 5. Belt groups 12*a* and 12*b* are each comprised of a plurality of belts. In a preferred embodiment, each belt group is comprised of five (5) belts. Belt groups 12*a*, 12*b* are interwoven such that the relative difference in height between motor shafts 16*a*, 16*b* is minimized. Belts 12*a* are drivingly engaged with pulley 3, and with pulley 18*a*, which is mounted on motor shaft 16*a*. Similarly, belt 12*b* is drivingly engaged with pulley 3, and pulley 18*b*, which is mounted to motor shaft 16*b*. Drive system 4 is configured in a manner such that the resultant tension from one set of belts is offset by an equivalent belt tension from the other set of belts. These two equal and opposite loads combined to produce a net resultant force of zero on shaft 5. Belts 12*a*, 12*b* are of the stretchable type and can be either V-shaped belts or flat belts. Each belt is positioned within corresponding pulley belt grooves 20. Referring to FIG. 3, a belt tensioning assembly is associated with each motor 10*a*, 10*b*. The belt tensioning assembly for motor 10*a* comprises plate 24*a*, rollers 22*a*, spring 26*a*, spring housing 27*a*, threaded rod 28*a* and hex nuts 30*a*. Adjusting hex nuts 30*a* will vary the tension in spring 26*a*. The tension in 26*a* determines how far plate 24*a* moves upon lip 31*a* of motor support 35*a*. Rollers 22*a* allow motor 10*a* and pulley 18*a* to roll upon plate 24*a* . Similarly, the belt tensioning assembly for motor 10*b* comprises plate 24*b*, rollers 22*b*, spring 26*b*, spring housing 27*b*, threaded rod 28*b* and hex nuts 30*b*. The function of the belt tensioning assembly for motor 10*b* is exactly the same as that for the belt tensioning assembly for motor 10*a*. The belt tensioning assemblies for motors 10*a* and 10*b* are supported by motor supports 35*a* and 35*b*, respectively. Belts 12*a*, 12*b* are completely positioned under belt guard 14. Belt housing 13 is attached to housing 11 and substantially envelops the portion of belts 12*a*, 12*b* that are in contact with pulley 3. Balanced drive system 4 maintains alignment of shaft 5 by keeping the shaft centered within housing 11.

Elongated hollow shaft 5 has a pair of concentrically arranged cylinders 15*a*, 7*a* disposed therein. Inner most cylinder 17*a* defines feed inlet chamber 17. The space intermediate the cylinders 15*a*, 17*a* defines overflow outlet chamber 15. Feed inlet 7 and overflow outlet 9 are supported by housing 11 and are in communication with feed inlet chamber 17 and overflow outlet chamber 15, respectively. The top portions of cylinders 15*a*, 17*a* are attached to housing 11 and do not rotate with shaft 5. Seals 46 and 48 are labyrinth seals and are utilized to maintain pressurized conditions. However, if a high pressure system is utilized, a liquid seal can also be used. Paring disc 52 is attached to feed pipe 50 and functions as a centripetal pump impeller for impelling the separated liquid into overflow outlet chamber 15. Functional aspects of disc 52 will be further discussed below in detail.

Elongated shaft 5 is rotatably engaged with angular contact bearings 33 and cylindrical roller bearings 55 which are disposed within bearing housing 34. Chamber 42 functions as a race for bearings 33 and 55 and also allows lubricating oil to circulate throughout the chamber. Angular contact bearings 33 receive the actual load from shaft 5 whereas cylindrical roller bearings 55 receive the radial load from shaft 5. Oil sump 44 collects lubricating oil that settles to the bottom portion of chamber 42. Oil nozzle 49 provides additional lubricating oil sufficient for lubrication. Air vents 43 provide air to chamber 42 in order to facilitate circulation of lubricating oil throughout chamber 42. Lubricating oil outlets 53 allow excess oil within chamber 42 to exit.

Curved swivel member 36 is positioned intermediate bearing housing 34 and swivel support 32 and is attached to swivel support 32. Bracket 39 retains rubber buffer 38 in a position intermediate swivel support 32 and bearing housing 34. Motor supports 35*a*, 35*b* are attached to bearing housing 34. During rotation, shaft 5 and bearing housing 34 swivel at the point of contact 37 intermediate swivel member 36 and bearing housing 34. Drive system 4 rotates shaft 5 at a first rotational speed, which in turn causes bowl 56, disc carrier 64 and discs 66 to rotate at the same rotational speed. Electronic bearing temperature monitors 45 are positioned in the upper and lower portions of bearing housing 34 for monitoring the temperature of bearings 33. If the temperature of the bearings should attain a predetermined temperature, monitor 45 will emit control signals to a control unit (not shown) which will inactivate centrifuge 1.

As shown in FIGS. 1 and 3, drive system 4, shaft 5, bearing housing 34, bowl assembly 6 and differential speed conveyor 8 are interconnected as one "unit". The entire "unit" rests upon curved swivel member 36. Thus, as a result of high gyroscopic forces that are created during the operation of the centrifuge, the aforementioned "unit" will translate freely or swivel so as to attain an optimal operational attitude. The swivel function significantly reduces stresses that are normally prevalent in a restrained centrifuge. The swivel function also allows motors 10*a*, 10*b* to retain their alignment thereby preserving the zero-net resultant force produced by the pendular drive system configuration which has been described above. In order to negate the possibility of sudden detrimental excursions and to damp vibrations, rubber buffer ring 38 is positioned intermediate bearing housing 34 and swivel support 32. Rubber buffer ring 38 does not limit the centrifuges potential range of motion as it translates or swivels. Ring 38 functions as a cushion so as to decelerate the rate of excursion and allows the "unit" to gradually attain its optimum operational attitude without producing any excessive forces on bearings 33 and 55. To facilitate the centrifuge's swiveling function and to damp vibrations, vibration absorbing rubber mount 40 is positioned intermediate swivel support 32 and support arms 102*a* and 102*b*. Support arms 102*a*, 102*b* are each welded to a respective support columns (see FIG. 1). Mount 40 and buffer ring 38 prevent vibrations that are external to centrifuge 1 from being transmitted to the centrifuge.

Figure 2:
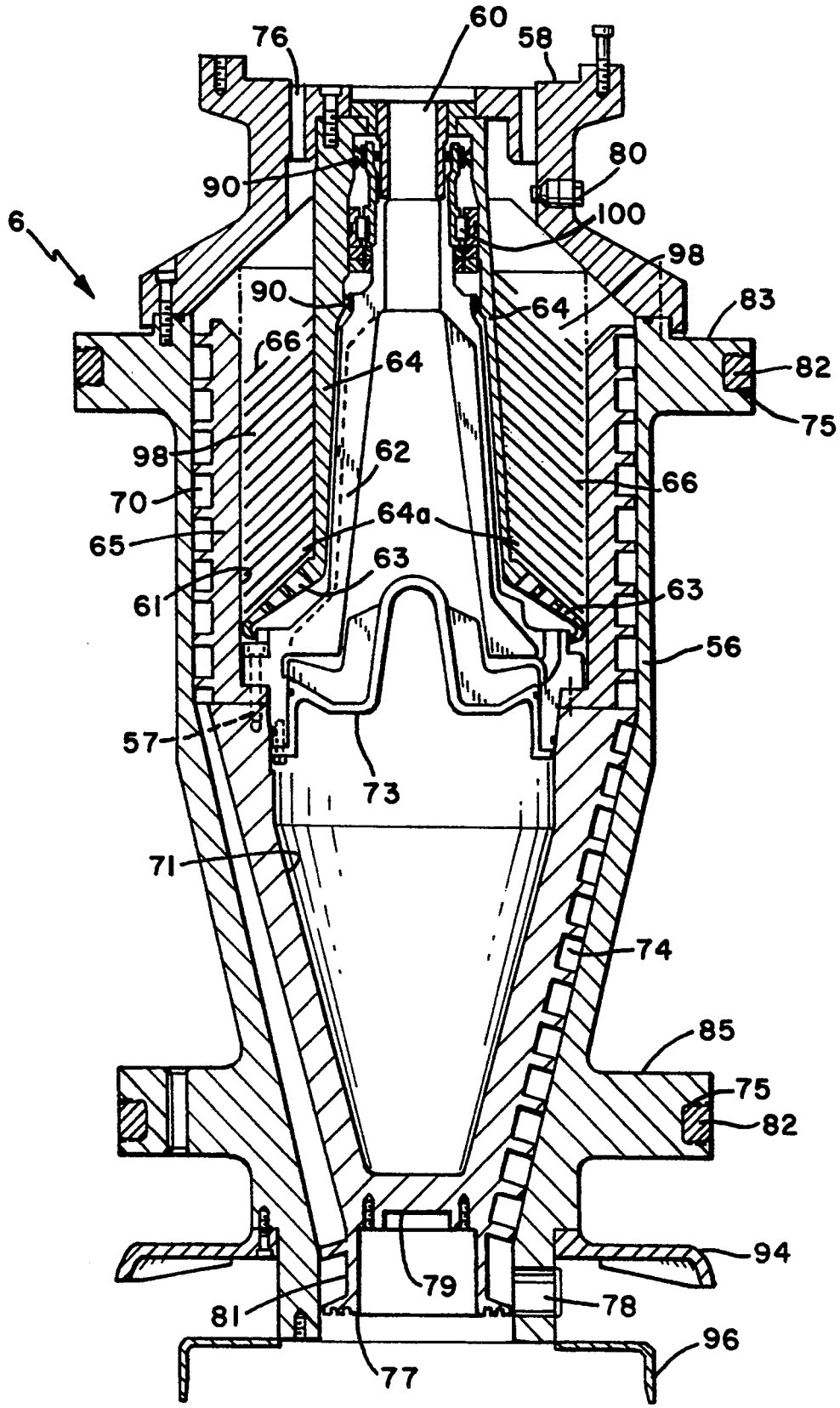
FIG. 2 is an enlarged front elevational view of the centrifuge bowl depicted in FIG. 1.
Figure 4:
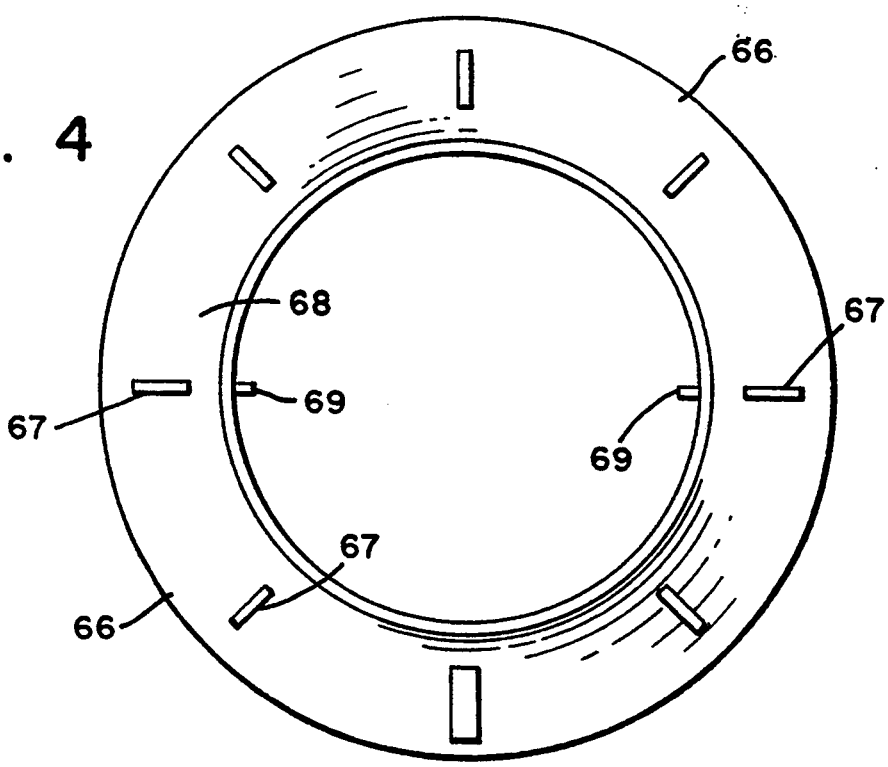
FIG. 4 is a top plan view of an individual circular disc utilized in the centrifuge of the present invention.
Figure 9:
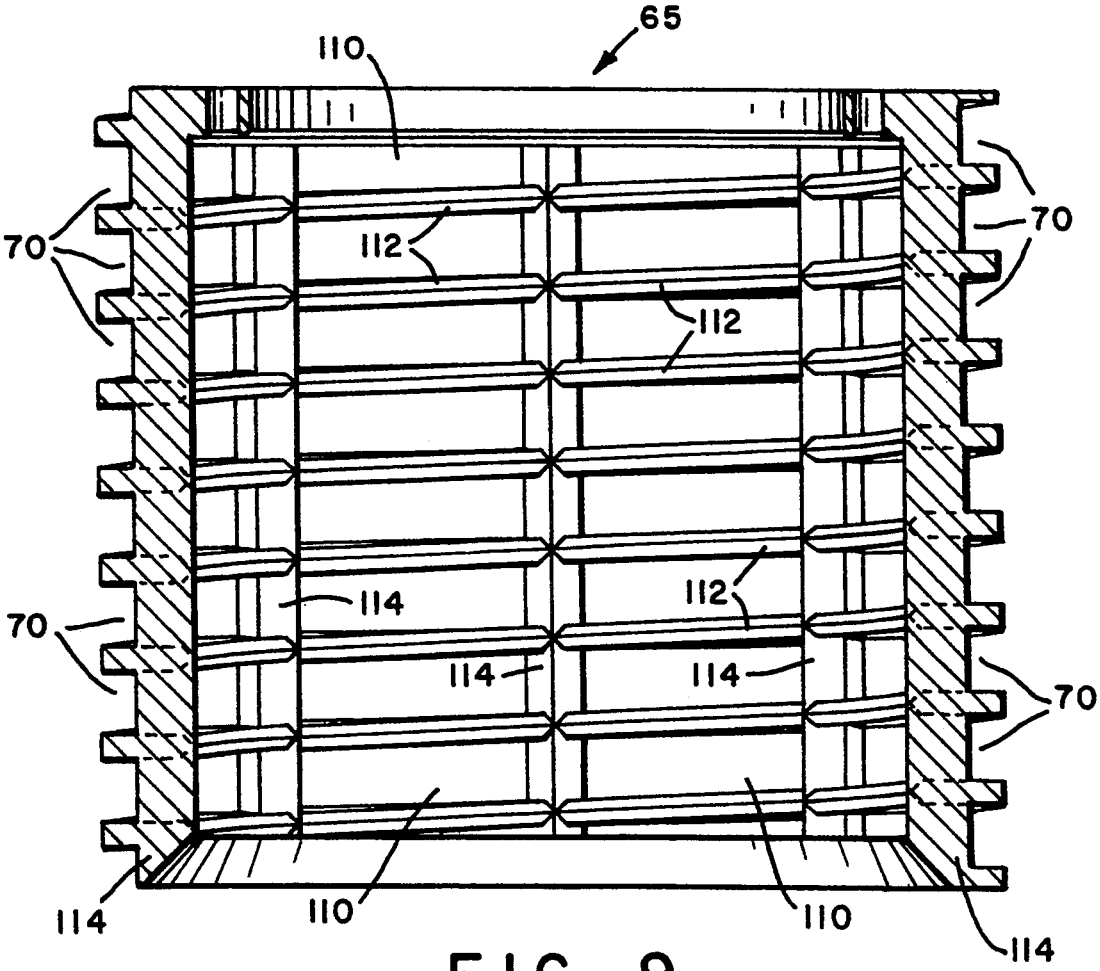
FIG. 9 is a side elevational view in cross-section taken along line 9—9 of FIG. 8.
Figure 8:
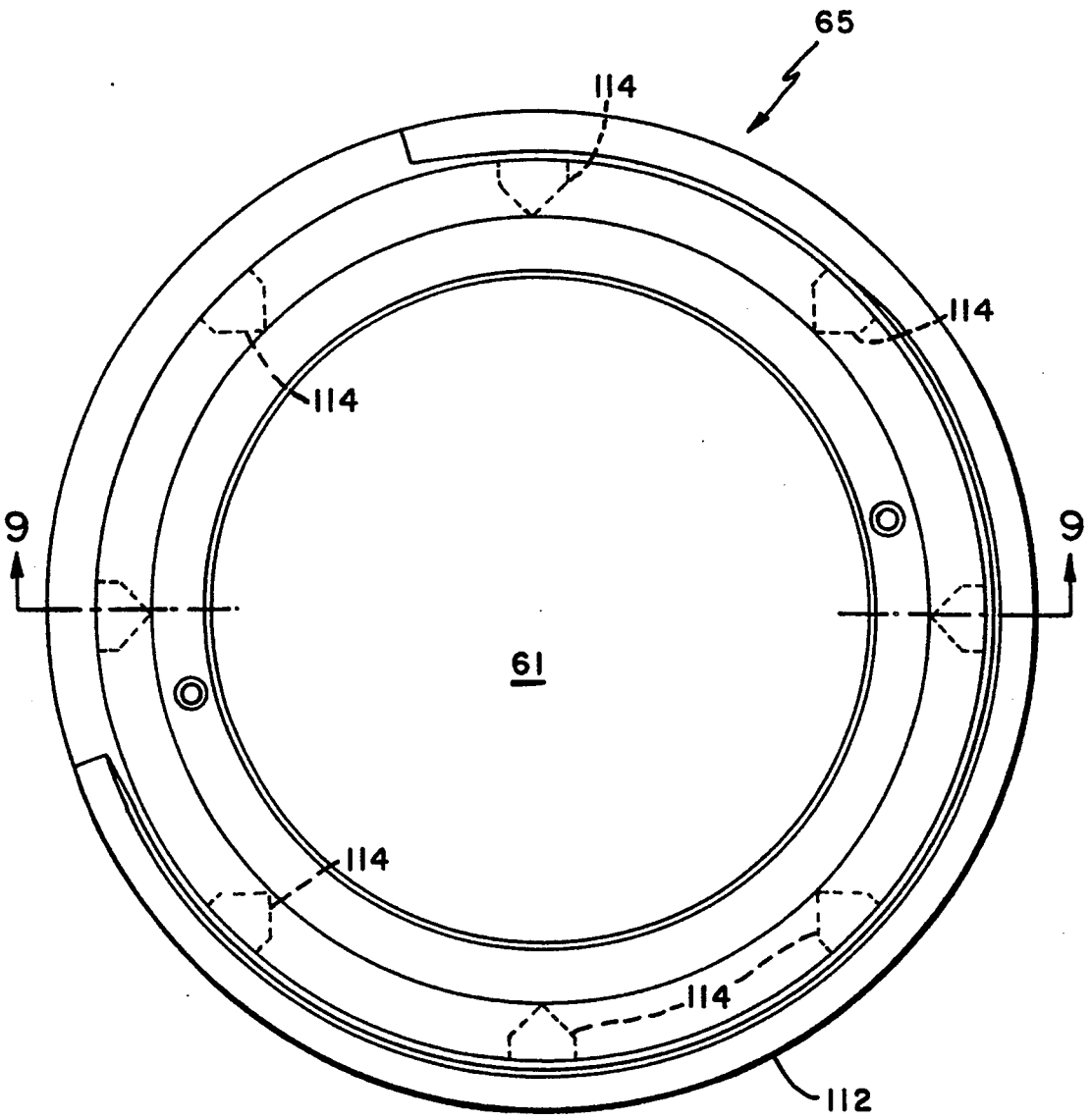
FIG. 8 is a top plan view of the cylindrically shaped screw conveyor depicted in FIG. 2.

Referring to FIG. 2, bowl assembly 6 comprises bowl 56, cylindrical screw conveyor 65, disc carrier 64, circular discs 66, distributor 62, accelerator 73 and conically shaped screw conveyor 71. Top end 58 of bowl 56 is attached to bottom end 54 of spindle shaft 5 (see FIG. 3). Cylindrically shaped screw conveyor 65 is disposed within the upper cylindrically shaped portion of bowl 56. Referring to FIGS. 8 and 9, screw conveyor 65 has grooves 70 helically formed on the outer surface thereof. Openings or slots 110 are formed intermediate helically formed ribs 112. Ribs 112 are attached to and supported by vertical members 114. Disc carrier 64 is longitudinally disposed within bore 61 of conveyor 65 and is coaxially attached to the upper portion of bowl 56. Cylindrical roller bearings 100 are positioned intermediate disc carrier 64 and distributor 62 and allow carrier 64 and distributor 62 to rotate relative to one another. Disc carrier 64 and screw conveyor 65 define separation chamber 98. Circular discs 66 are disposed within chamber 98 and arranged in superimposed layers upon disc carrier 64. The lower radially extending portion 64*a* of disc carrier 64 has passages 63 formed therethrough which lead into chamber 98. Overflow passage 76 is formed in end 58 of bowl 56, the purpose of which will be explained below. Bore 60 is coaxially aligned with shaft 5 and receives feed pipe 50 (see FIG. 3). Feed pipe 50 is attached to inner most cylinder 17*a* and is in communication with feed inlet chamber 17. Distributor 62 is longitudinally disposed within disc carrier 64 and is attached to conveyor 65 via screws 57. Thus, distributor 62 rotates with conveyors 65 and 71. Distributor 62 receives the feed from feed pipe 50. Accelerator 73 is attached to distributor 62 and impels feed through passages 63 and evenly distributes feed throughout lower portion 64*a* of disc carrier 64. Referring to FIG. 4, circular discs 66 are disposed within chamber 98 and are mounted upon disc carrier 64 in superimposed layers. Mounting tabs 69 of each disc 66 are received in a corresponding longitudinally formed channels (not shown) in the outer surface of disc carrier 64. Spacers 67 are attached to top surface 68 of each disc 66. In a preferred embodiment, spacers 67 are welded to top surface 68 and the disc is fabricated from stainless steel sheets. The thickness of each spacer 67 determines the amount of space between each of the discs, and the number of discs 66 that can be disposed within chamber 98. As the space between discs 66 is reduced, more discs 66 can be disposed within chamber 98 thereby increasing the settling area and thus, increasing the degree of separation. Therefore, the space between each disc 66 determines the degree of separation (or classification) for a particular feed input. Chamber 98 and disc carrier 64 are configured in a manner such that up to 200 discs 66 can be disposed within chamber 98.

Figure 5:
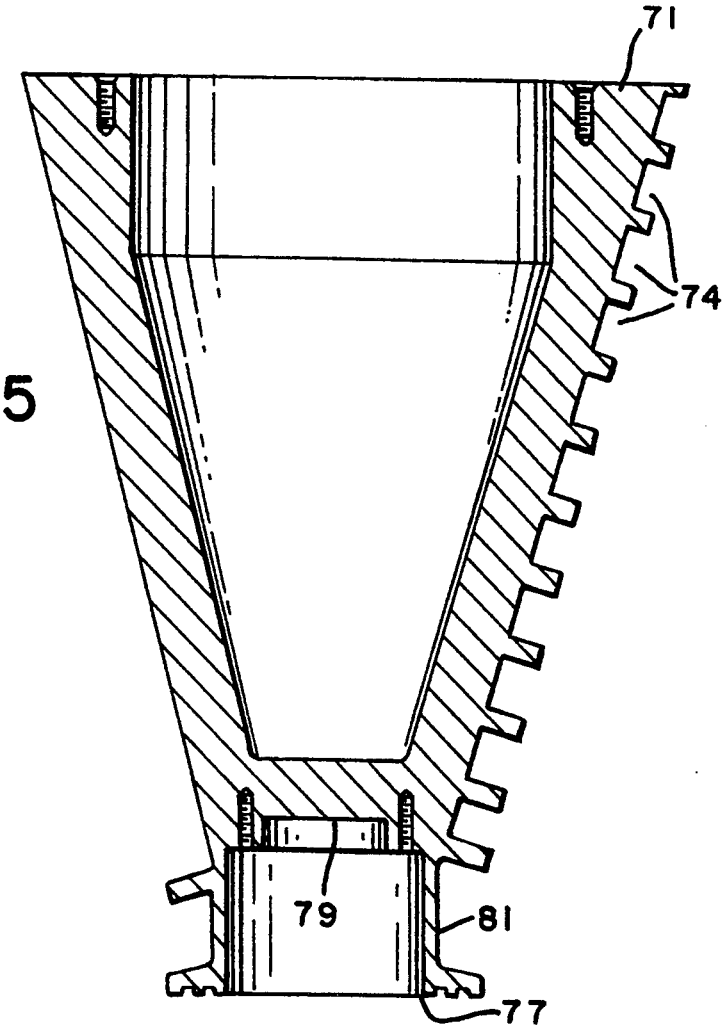
FIG. 5 is a side elevational view in cross-section of the conically shaped screw conveyor utilized in the centrifuge of the present invention.
Figure 6:
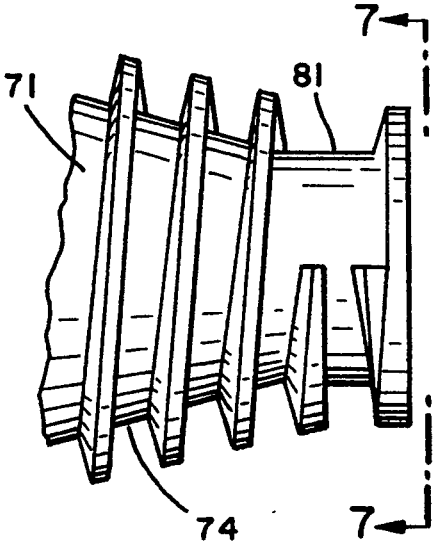
FIG. 6 is a side elevational view of the lower portion of the conically shaped screw conveyor depicted in FIG. 5.
Figure 7:
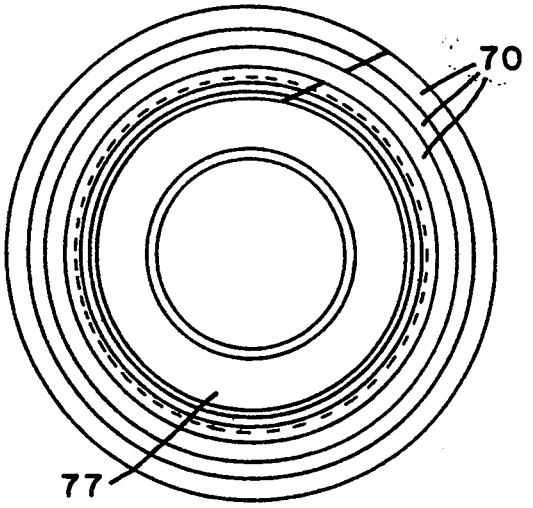
FIG. 7 is an end view taken along line 7—7 of FIG. 6.

Conically shaped screw conveyor 71 is longitudinally disposed in the lower conically shaped portion of bowl 56 and is coaxially attached to cylindrically shaped screw conveyor 65. Screw conveyor 71 has grooves 74 helically formed on the outer surface thereof (see FIGS. 5–7). Screw conveyor 65 and 71 are rotatable with respect to bowl 56. Referring to FIGS. 2 and 6, conical screw conveyor 71 has a smooth portion 81 adjacent bottom end 77. Portion 81 is aligned with underflow outlet 78. Underflow outlet 78 is centrally positioned intermediate upper slinger 94 and lower slinger 96.

Figure 10:
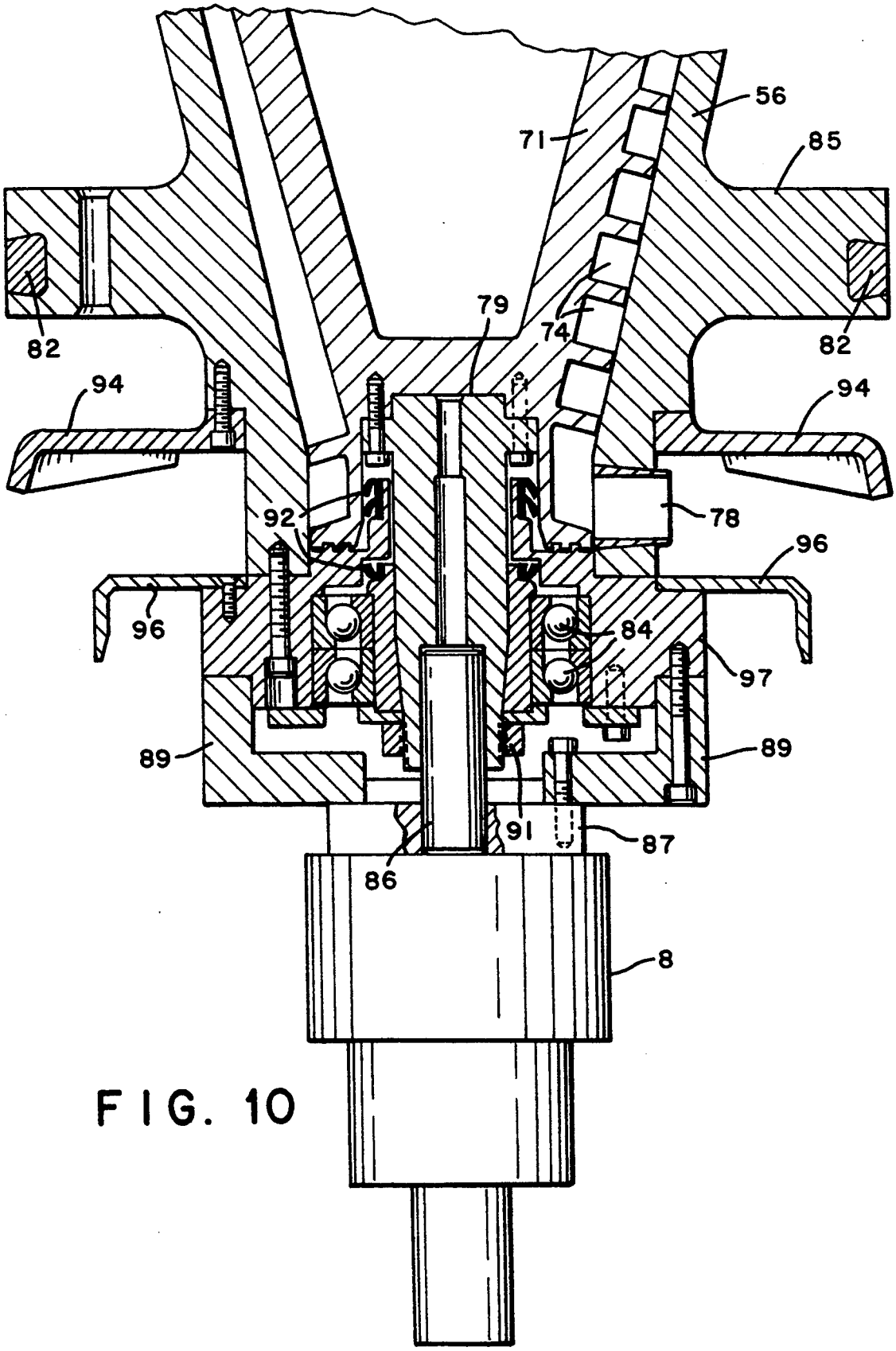
FIG. 10 is an enlarged view of the differential speed conveyor depicted in FIG. 1.

Referring to FIG. 10, differential speed conveyor (conveyor drive or backdrive) 8 is removably attached to end surface 79 of conically shaped screw conveyor 71 and is completely enveloped by housing 25 (see FIG. 1). Differential speed conveyor 8 is comprised of rotating disc 87 and shaft (motor rotor) 86. Angular contact bearings 84 are positioned intermediate and rollably engaged with rotatable mounting plate 89 and shaft 86. Disc 87 is removably attached to and is driven by bowl 56 and therefore rotates at the rotational speed of bowl 56. Shaft 86 is removably attached to end 79 of conically shaped screw conveyor 71. Shaft 86 is driven by differential speed conveyor 8 and thus rotates screw conveyor 65 and 71 at a predetermined rotational speed, which, in a preferred embodiment, is within the range of about 1 r.p.m. (revolutions per minute) to about 100 r.p.m. above or below the rotational speed of shaft 5. In a preferred embodiment, screw conveyors 65 and 71 rotate at a rotational speed within the range of about 5900 r.p.m. to about 5999 r.p.m., or 6001 r.p.m. to about 6100 r.p.m. Since bowl 56 is rotating at a rotational speed of 6000 r.p.m., a differential speed $\Delta V$ is produced which can be expressed as:

$$\Delta V \text{ equals } V_B - V_C$$

wherein $V_B$ is the rotational speed of bowl 56; and $V_C$ is the rotational speed of screw conveyor 65 and 71. Differential speed conveyor 8 is attached to and removed from bowl 56 as a single contiguous unit. Conveyor 8 can be removed from bowl 56 by removing, housing 25, drive mounting plate 89, intermediate mounting plate 97 and locking nut 91. Conveyor drive assembly 8 can then be removed from bowl 56 as a single assembly and in a single step. Since conveyor 8 is attached to bowl 56, conveyor drive 8 translates or swivels with the "unit", as previously defined herein, as the "unit" searches for its optimum operational attitude. Hence, no loads are placed on the centrifuge as would be the case if a conventional belt or directly coupled drive system was used in place of conveyor drive 8. A variety of vertically mounted conveyor drives may be utilized with the centrifuge of the present invention, e.g. hydraulic, electrical, pneumatic, etc. In a preferred embodiment, differential speed conveyor 8 is Rotodiff™ Model No. 1060D manufactured by Viscotherm AG. Seals 92 are utilized to prevent any leakage of solids concentrate, from helical grooves 74, upon bearings 84. Seals 92 are of a labyrinth-type configuration.

The aforementioned rotational speeds are preferred for operation of centrifuge 1. However, the centrifuge of the present invention may be operated with a drive system 4 and differential speed conveyor 8 which provide different rotational speed. Such would be the case if small-size drive systems or differential speed conveyors are utilized.

Figure 11:
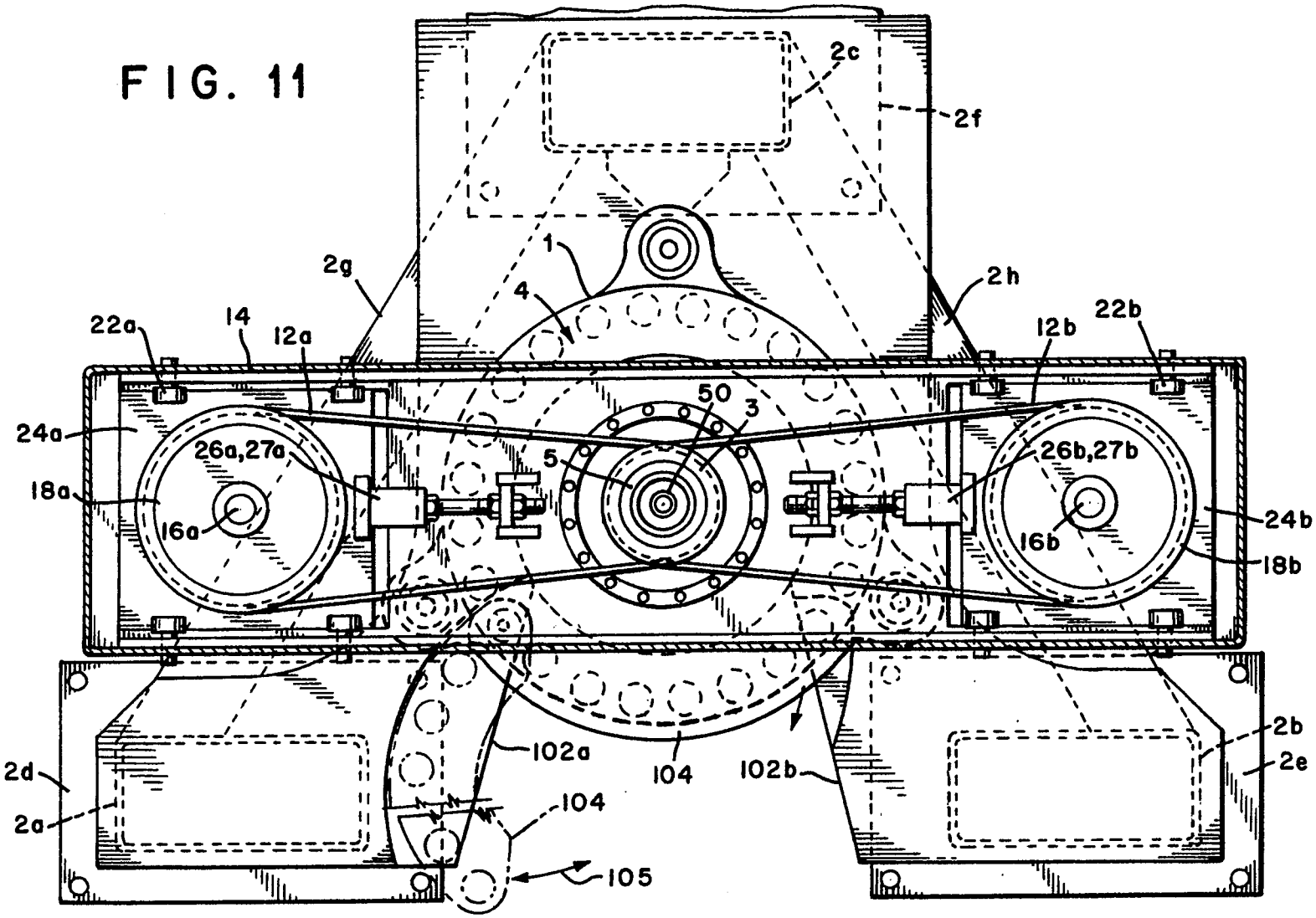
FIG. 11 is a top plan view taken along line 11—11 of FIG. 1.

Referring to FIG. 11, lateral swing arm 104 swings in the directions indicated by arrow 105 and allows centrifuge 1 to be laterally inserted into and removed from the space between support columns 2. A multi-section housing, comprising sections 59*a–d*, completely envelopes bowl 56, differential speed conveyor 8 and conveyor housing 25. Lateral assembly of the centrifuge is achieved via vertically split enclosure housing section 59*a*. The lateral movement of arm 104 facilitates accessing centrifuge 1 for purposes of conducting maintenance and repairs. This is a significant advantage over conventional vertically oriented centrifuges which require that the centrifuge be dropped into its enclosure from the top. Furthermore, longitudinal installation requires greater overhead space than lateral installation. Seals 23 gaseously couple each section together so as to retain pressurized gases, which may be necessary to implement certain separation processes, between bowl 56 and housing 25. Such pressurized gases may be, for instance, nitrogen.

Isolators 21 are positioned intermediate bearing housing 34 and housing section 59*a*. Isolators 21 serve two functions. First, the isolators isolate the enclosure and frame thereby preventing vibrations from being translated into bowl 56 and differential speed conveyor 8. Second, isolators 21 accommodate the removal of split housing 59*a* by obviating the need to remove the enclosure top 59*b*. Enclosure top 59*b* is easily slid upward so split housing 59*a* may be removed.

The vertical split housing design is also instrumental in balancing centrifuge 1. Referring to FIG. 2, balancing rings 83 and 85 are formed in the upper and lower periphery, respectively, of bowl 56. Dovetail groves 75 are formed in each ring 83, 85 and receive and retain therein balancing weights 82. Weights 82 are positioned so as to minimize the magnitude of the vibrations of the operating centrifuge. Angular degree notations are etched in the outer circumference of balancing rings 83, 85 so as to provide a reference for positioning balancing weights 82. Weights 82 are inserted into dovetail grooves 75 to any radial position and are then locked into place using a set screw (not shown). Non-contacting proximity probes 106 are utilized to determine the vibration amplitude of the centrifuge during operation. The combination of the split housing, balancing rings and non-contacting proximity probes allow for high speed in situ balancing.

OPERATION

In accordance with the present invention, a feed slurry is fed into feed inlet 7. The feed travels through inner most cylinder 17*a* which forms feed inlet chamber 17. The feed then exits chamber 17 and enters bowl 56 where accelerator 73 impels the feed mixture through passages 63 and into separation chamber 98. Accelerator 73 then uniformly distributes the feed throughout the lower interior of disc carrier 64. Discs 66 cooperate with the centrifugal force created by the rotation of bowl 56 so as to incrementally separate the solids from the liquid slurry. As the slurry moves inward along discs 66, the solids collect on the underside of the discs. The solids then eventually move outward from the center of the discs and through openings 110 in cylindrical screw conveyor 65. The solids then are conveyed via helical grooves 70 to conically shaped screw conveyor 71. Helical grooves 74 of screw conveyor 71 continue to convey the solids downward through bowl 56 so as to allow the solids to exit underflow outlet 78. The differential speed between bowl 56 and screw conveyors 65 and 71 cause the conveyance of solids through the helical grooves 70 and 74 of screw conveyors 65 and 71, respectively, to underflow outlet 78. The solids exit underflow outlet 78 and fall upon the inside surface of housing section 59*d* where the solids are discharged through main underflow outlet 29. Paring disc 52 pressurizes the separated liquid, which is spinning at a rotational velocity of 6000 r.p.m., so as to cause the liquid to pass though passages 76 and into overflow outlet chamber 15. Thus, paring disc 52 converts a "velocity head", generated by the spinning liquid, into a "pressure head". The separated liquid or liquid overflow exits the centrifuge via overflow outlet 9.

The centrifuge of the present invention is also capable of "tri-phase" separation wherein a feed concentration or slurry is divided into a liquid concentrate, a solid concentrate, and a third concentrate having a concentration density between that of the liquid and solid concentrate. For instance, if a feed slurry comprising water, oil and sand is fed into feed inlet 7, the aforementioned separation process would effect a separation whereby the oil would be discharged through overflow outlet 9, the sand would be discharged through underflow outlet 78 and the water, which has a density between that of oil and sand, would be discharged through third phase (medium-density) outlet 80 (see FIG. 2).

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

While the invention has been illustrated and described in what are considered to be the most practical and preferred embodiments, it will be recognized that many variations are possible and come within the scope thereof, the appended claims therefore being entitled to a full range of equivalents.

Thus, having described the invention, what is claimed is:

1. A centrifuge having a vertical axis of rotation and supported by a support structure for effecting the separation of a feed mixture into multiphase fractions, said centrifuge comprising:

a shaft positioned upon and rotatably attached to said support structure;

a bowl coaxially attached to and rotatable with said shaft;

a heavy fraction chamber adjacent one end of said bowl in communication with the interior of said bowl through a heavy fraction discharge opening;

an inlet in communication with said bowl for introducing said mixture into said bowl;

a rotatable screw conveyor longitudinally disposed within and coaxial with said bowl;

a hub member disposed within the upper portion of said screw conveyor, said hub member being coaxially attached to and rotatable with said bowl, the space intermediate said conveyor and said hub member defining a separation chamber;

a plurality of separating discs disposed in said separation chamber and stacked in superimposed layers upon said hub member;

a distributor disposed within said hub and in communication with said inlet means so as to receive the feed mixture, said distributor being attached to said conveyor, said hub having a plurality of passages in the lower portion thereof which lead into said separation chamber;

an accelerator attached to said distributor for impelling the feed mixture through said passages of said hub and into said separation chamber;

means coupled to said shaft and conveyor for rotating said bowl and conveyor at different speeds; and a light fraction discharge outlet in communication with said separation chamber for discharging a light fraction from said bowl.

2. A centrifuge having a vertical axis of rotation and supported by a support structure for effecting the separation of a feed mixture into multiphase fractions, said centrifuge comprising:

a shaft positioned upon and rotatably attached to said support structure;

a plurality of bearings rotatably engaged with said shaft;

a bearing housing enveloping said plurality of bearings and swivably engaged to said support structure so as to allow said shaft to translate freely in order to obtain an optimum operational attitude during rotation thereof;

a bowl coaxially attached to and rotatable with said shaft;

a heavy fraction chamber adjacent one end of said bowl in communication with the interior of said bowl through a heavy fraction discharge outlet;

an inlet in communication with said bowl for introducing said mixture into said bowl;

a rotatable screw conveyor longitudinally disposed within and coaxial with said bowl;

a hub member disposed within the upper portion of said screw conveyor, said hub member being coaxially attached to and rotatable with said bowl, the space intermediate said conveyor and said hub member defining a separation chamber;

a plurality of separating discs disposed in said separation chamber and stacked in superimposed layers upon said hub member;

means for distributing said mixture into said separation chamber;

a pair of diametrically positioned motors for rotating said shaft at a first rotational speed, each of said motors being supported by said bearing housing;

a set of belts associated with each of said motors, each of said sets of belts being drivingly engaged with a corresponding one of said motors and said shaft;

a differential speed drive rotatably engaged with said bowl for rotating said screw conveyor at a second rotational speed; and a light fraction discharge outlet in communication with said separation chamber for discharging a light fraction from said bowl.

3. The centrifuge of claim 2 further including a pair of tension adjustors, each of which being operably associated with a corresponding one of said motors for adjusting the tension of each of said sets of belts.

4. The centrifuge of claim 2 further including:

a pair of balancing rings formed in the periphery of said bowl, each balancing ring having a groove formed therein; and at least one weight adjustably positioned within said groove of a corresponding one of said rings.

5. The centrifuge of claim 2 further including:

a first vibration absorbing means positioned intermediate said bearing housing and said support structure; and means for retaining said first vibration absorbing means in said position intermediate said bearing housing and said support structure.

6. The centrifuge of claim 5 further including:

a housing enveloping said bowl; and a second vibration absorbing means intermediate said housing and said shaft so as to prevent vibrations from being transmitted to said housing.

7. The centrifuge of claim 2 wherein said shaft is hollow and has a pair of concentrically arranged cylinders coaxially disposed therein, the innermost cylinder defining said inlet, the space intermediate said pair of cylinders defining said light fraction discharge outlet.

8. The centrifuge of claim 2 further including a bearing temperature monitor for monitoring the temperature of said bearings.

9. The centrifuge of claim 8 further including means, on said centrifuge, for lubricating said bearings.

10. The centrifuge of claim 2 wherein said bowl has an upper cylindrically shaped portion and a lower conically shaped portion.

11. The centrifuge of claim 10 wherein said screw conveyor is comprised of an upper cylindrically shaped portion located within said cylindrically shaped portion of said bowl, and a lower conically shaped portion located within said lower conically shaped portion of said bowl.

12. The centrifuge of claim 11 wherein said heavy fraction discharge outlet is positioned in the lower conically shaped portion of said bowl.

13. The centrifuge of claim 12 further including a medium-density fraction discharge outlet in communication with said separation chamber.

14. The centrifuge of claim 2 further including a plurality of spacers having a predetermined thickness and attached to the top surface of each of said discs so as to define the volume between said discs.

15. The centrifuge of claim 2 further including a swing arm pivotally attached to said support structure for lateral motion, said swing arm supporting said centrifuge so as to allow said centrifuge to be moved laterally in relation to said support structure.

16. The centrifuge of claim 2 further including means for impelling said light fraction from said separation chamber into said light fraction discharge outlet.

* * * * *

UNITED STATES PATENT AND TRADEMARK OFFICE

CERTIFICATE OF CORRECTION

PATENT NO. : 5,364,335

DATED : November 15, 1994

INVENTOR(S) : Frazen et al.

It is certified that error appears in the above-identified patent and that said Letters Patent is hereby corrected as shown below:

In column 3, line 30, please delete "7a" and substitute therefor - -17a- -.

Signed and Sealed this

Tenth Day of January, 1995

Bruce Lehman

*Attest:*

BRUCE LEHMAN

*Attesting Officer*

*Commissioner of Patents and Trademarks*